US008138131B2

(12) United States Patent
Li

(10) Patent No.: US 8,138,131 B2
(45) Date of Patent: Mar. 20, 2012

(54) LUBRICATING OIL COMPOSITION FOR DIESEL OIL VEHICLE

(75) Inventor: Zhengzhao Li, Beijing (CN)

(73) Assignee: Beijing Hookeyvery Lubrication Technology Co., Ltd., Beijing (CN)

( * ) Notice: Subject to any disclaimer, the term of this patent is extended or adjusted under 35 U.S.C. 154(b) by 590 days.

(21) Appl. No.: 12/162,192

(22) PCT Filed: Mar. 2, 2006

(86) PCT No.: PCT/CN2006/000304

§ 371 (c)(1), (2), (4) Date: Nov. 4, 2008

(87) PCT Pub. No.: WO2007/085130

PCT Pub. Date: Aug. 2, 2007

(65) Prior Publication Data

US 2009/0305921 A1 Dec. 10, 2009

(30) Foreign Application Priority Data

Jan. 25, 2006 (CN) ..... 2006 1 0001777

(51) Int. Cl.
*C10M 169/04* (2006.01)
*C07D 251/54* (2006.01)

(52) U.S. Cl. ..... 508/257; 508/258

(58) Field of Classification Search ..... 508/257, 508/258

See application file for complete search history.

(56) References Cited

U.S. PATENT DOCUMENTS

| | | | | |
|---|---|---|---|---|
| 3,642,630 | A | 2/1972 | MacPhail et al. | |
| 4,038,197 | A | 7/1977 | Caspari | |
| 4,256,591 | A * | 3/1981 | Yamamoto et al. | 508/258 |
| 5,002,676 | A * | 3/1991 | Willis et al. | 508/472 |
| 5,032,301 | A | 7/1991 | Pawloski et al. | |
| 6,528,460 | B2 | 3/2003 | Kawata et al. | |
| 2002/0072477 | A1 * | 6/2002 | Ikejima et al. | 508/181 |
| 2004/0097381 | A1 * | 5/2004 | Finmans et al. | 508/172 |

FOREIGN PATENT DOCUMENTS

| | | |
|---|---|---|
| CN | 1403554 | 3/2003 |
| EP | 1164182 A1 | 12/2001 |
| GB | 1358045 | 6/1974 |
| WO | 0040678 | 7/2000 |

* cited by examiner

*Primary Examiner* — Walter D Griffin
*Assistant Examiner* — Francis C Campanell
(74) *Attorney, Agent, or Firm* — Volpe and Koenig P.C.

(57) ABSTRACT

A lubricating oil composition for diesel oil vehicle comprises lubricating base oil, in which the composition further comprises triazine compound. The wheel rim power of the diesel oil vehicle is increased by 8-10%, the carbon smoke particulate discharge in tail gas is reduced by 30-50%, oil saving rate is high up to more than 10% and the oil change-over period of machine oil is 2-3 times of that of a conventional one; the discharge fully meets the standard, at the same time eliminates the bad smell and taste of the raw oil, the tail gas discharge of currently used vehicle or new vehicle meet the national standards by using the lubricating oil composition provided by the present invention.

7 Claims, No Drawings

LUBRICATING OIL COMPOSITION FOR DIESEL OIL VEHICLE

FIELD OF THE INVENTION

The present invention relates to an automobile lubricating oil composition, particularly relates to a lubricating oil composition for diesel oil vehicle.

BACKGROUND OF THE INVENTION

Diesel oil vehicle has the merit of high power, low operation cost, and easily accessible fuel resource, and draws great attention from manufacturer and market. But harmful gases with heavy smoke (carbon soot particulate), bad smell, and raw oil odor in exhaust gas discharged by the diesel oil vehicle are hazard to human health and ecological environment, so many countries and regions including China forbid or restrict diesel oil vehicles from entering into downtown and busy area, which makes production and development of diesel oil vehicles under great restriction. With rise in awareness of environment protection, the influence becomes more and more intense, thus the issue for resolving discharge of carbon soot particulates in exhaust gas discharged by diesel oil vehicle attracts worldwide attention.

The carbon soot particulates in exhaust gas discharged by diesel oil vehicles are mainly generated by incomplete fuel combustion and oil burning and gas leakage of engine. Recently, for effectively controlling discharge of carbon soot particulates from diesel oil vehicle, much research work is carried out, various measures are taken, such as, improving material and process of engine, improving engine quality (including increasing turbocharger system), decreasing sulfur content of diesel oil, improving fuel quality, and adding external purifier, and certain progress is achieved as well. But aforementioned measures can only decrease carbon soot particulate discharge amount of diesel oil vehicles to some extent, and can not radically solve aforementioned issues of diesel oil vehicles. Additionally, aforementioned schemes require extra equipment or process, and the operation is rather cumbersome.

Presently, there is still no such a scheme which can radically solve issue of carbon soot particulate discharge of diesel oil vehicles without requiring extra equipment or process in market, and make the discharge amount of carbon soot particulate in exhaust gas in diesel oil vehicle reach or be better than national discharge standard.

Presently, the common lubricating oil mainly comprises base oil as main component and additives as auxiliary component for improving various properties, such as dispersing agent, friction reducer, and viscosity improver. The aforementioned lubricating oil is mainly used to build oil film between piston and cylinder and between main shaft and bush which slide relatively, for exerting lubrication and friction reducing functions, and preventing excessive wearing of those parts. Until now, there is still no such lubricating oil available which is useful for controlling or reducing carbon soot particulates in exhaust gas discharged by diesel oil vehicles.

SUMMARY OF THE INVENTION

The object of the present invention is to overcome the disadvantage of available lubricating oil which can not reduce carbon soot particulate discharge in exhaust gas discharged by diesel oil vehicles, and to provide a lubricating oil composition for diesel oil vehicles which can reduce carbon smoke discharge in exhaust gas discharged by diesel oil vehicles.

The present invention provides a lubricating oil composition for diesel oil vehicle, which comprises base oil, wherein the lubricating oil composition further comprises triazine compound.

As the lubrication oil composition provided in the present invention comprises triazine compound, it has excellent viscosity-temperature characteristics, can form stable oil film at temperature of 300° C., has less viscosity increase at −40° C., will not cause carbon deposition and gel-like matter, has good cleaning effect for engine, has effects in improving air tightness of engine cylinder, and stabilizing and restoring cylinder pressure, and not only can make engine cylinder pressure of new vehicle keep stable, but also can make cylinder pressure of in-use vehicle be restored, inhibit failure of oil burning and gas blow-by of engine, and promote full combustion of fuel.

By using the lubricating oil composition provided by the present invention, the diesel oil vehicle has improved air tightness of engine cylinder, eliminates occurrence of oil burning and gas leakage, stabilizes and restores cylinder pressure, and promotes full combustion of fuel, so that on the premise that the engine has improved power performance, reduced consumption of fuel and engine oil, reduced machine wearing, and prolonged engine service life and maintenance period, the issue regarding carbon soot particulate of diesel oil vehicles can be radically solved to make the carbon soot particulate discharge reach or even be better than national standard, at the same time rural and civil air quality is improved by eliminating bad smell and raw oil odor in exhaust gas, and solid foundation for research of energy saving and environment friendly products of diesel oil vehicle, vessel, and construction machine using diesel oil engine can be established. The diesel oil vehicle using the inventive lubricating oil composition has good power performance and starting performance even in alpine area (−40° C.), hot tropical area (40-50° C.), plateau oxygen deficiency area and mines with harsh road conditions, therefore driving safety is dramatically improved. Specifically, the diesel oil vehicle using the inventive lubricating oil has the carbon soot particulate discharge in exhaust gas reduced by 30-50%, wheel rim power increased by 8-10%, oil saving rate more than 10%, and the oil change-over period of 2-3 times of that of conventional one, which fully meets national standards while eliminating the bad smell and the raw oil odor in exhaust gas.

DETAILED DESCRIPTION OF THE PREFERRED EMBODIMENTS

Although a small amount of triazine compound can achieve the object of the present invention, preferably, the triazine compound content is preferably 1-20 wt %, more preferably 1-5 wt %, based on weight of the base oil of the lubricating oil.

The triazine compound refers to six-membered heterocyclic rings containing three nitrogen atoms, for the compound with the three nitrogen atoms in mutual meta position is called s-triazine. The triazine compound in the present invention is preferably s-triazine. The s-trazine compound has structure as shown in formula (1):

(1)

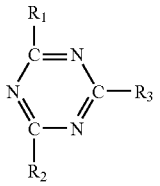

wherein $R_1$, $R_2$, $R_3$ are independently selected from hydrogen, alkyl, halogen, nitro, amino, hydroxyl, and sulfonic group. The halogen can be F, Cl, Br, or I. The alkyl can be aliphatic alkyl, or aromatic alkyl. The amino group can be primary amino, secondary amino, or tertiary amino. Preferably, $R_1$, $R_2$, and $R_3$ in the triazine compound of the present invention are independently selected from amino and hydroxyl. When $R_1$, $R_2$, and $R_3$ are all amino groups, the triazine compound is called triamino s-triazine, and the said amino group can be primary amino, secondary amino, or tertiary amino; when $R_1$, $R_2$, and $R_3$ are all hydroxyl, the triazine compound is called trihydroxy s-triazine. More preferably, the triazine compound in the present invention is triamino s-triazine, trihydroxy s-triazine, triamino s-triazine ammonium salt or mixture thereof. More preferably, the triazine compound in the present invention is mixture formed by mixing triamino s-triazine and trihydroxy s-triazine at molar ratio of 0.5-1.5. More preferably, the amino groups are all primary amino groups. As hydrogen atom of the primary amino group and that of the hydroxyl can easily form hydrogen bond, mixture of triamino s-triazine and trihydroxy s-triazine can be presented by formula (2):

(2)

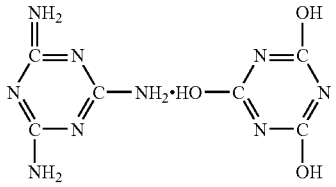

The aforementioned triazine compound can be prepared by various methods, or available commercially, such as bought from Beijing Shuangbotong Environment Protection Energy Saving Science and Technology Development Co. Ltd. or Hebei Quzhou Chemical Factory. In the embodiment of the present invention, the triazine compounds are all bought from Beijing Shuangbotong Environment Protection Energy Saving Science and Technology Development Co. Ltd.

The base oil of the lubricating oil can be various routine base oils for lubricating oil, such as mineral base oil, synthetic base oil like atmospheric/vacuum distillation light fraction, or solvent deasphalted oil. The base oil in the present invention is preferably various base oils with viscosity of 10w/30 and 15w/40, such as brand name of CC, CD, CF-4, SD/CC, SG/CF-4, or mixture thereof at any ratio.

For improving kinetic viscosity of the lubricating oil, the inventive lubricating oil may further comprise viscosity improver 0-5 wt % based on the weight of the base oil. The viscosity improver can be various viscosity improvers for improving shearing stability and/or thermal stability of the lubricating oil, such as one or more of ethylene-propylene polymer, random copolymer of α-olefin and aromatic vinyl compound, isopendiene-styrene copolymer, and polymethacrylate. In the embodiment of the present invention, viscosity improver is preferably one or more of the viscosity improver with the brand name of T612, T612A, T613, T614, and upper 603. The viscosity improver preferably has content of 0.5-3 wt % based on total weight of the base oil. Surprisingly, the inventor has found that the lubricating oil formed by mixture of triamino s-triazine and trihydroxy s-triazine, and polymethacrylate especially brand name of upper 603 antistatic enhanced stabilization additive (mentioned as "upper 603" below) has excellent viscosity temperature characteristic, therefore, in the present invention, the triazine compound is the mixture containing triamino s-triazine and trihydroxy s-triazine, the viscosity improver is the upper 603 viscosity improver, and the mixture of triamino s-triazine and trihydroxy s-triazine has a triamino s-triazine/trihydroxy s-triazine molar ratio of 0.5-1.5.

Preferably, the lubricating oil in the present invention may further comprise dispersing agent 0-5 wt % by weight of the base oil. The dispersing agent can be various dispersing agents for improving lubricating oil clean dispersivity, which includes metal type dispersing agent, or ashless dispersing agent. Said ashless dispersing agent can be one or more of polyisobutylene succinimide, dialkenyl succinimide, polyisobutylene succinate, and polyisobutylene ashless phosphate. In the present invention, said dispersing agent can be various dispersing agent with brand name of T152, T152A, T153, T154, or T155. The dispersing agent can be available commercially, or prepared by various methods. Preferably, the dispersing agent has content of 0.5-3 wt % based on weight of the base oil.

For further reducing wearing of engine, the lubricating oil in the present invention further may comprise friction reducer 0-5 wt % based on weight of the base oil. The friction reducer can be various friction reducers for reducing engine wearing, such as one or more of organomolybdenum friction reducer, polytetrafluoroethylene (PTFE), organoboron friction reducer, Fkm-1 type oil friction reducer, FOMP-1 type engine shaping agent, and MB202 friction reducer. The friction reducer in the present invention is preferably mixture of polytetrafluoroethylene and Fkm-1 type oil friction reducer, and the mixing ratio is preferably polytetrafluoroethylene/Fjm-1 type oil friction reducer weight ratio of 1-60. The friction reducer preferably has content of 0.5-3 wt % based on weight of the base oil.

For achieving various optimized performances, the lubricating oil in the present invention may further comprise various other additives as needed, such as one or more of pour point depressant, antioxidant, extreme pressure agent, antifoaming agent, and metal deactivator. The type and usage amount of the aforementioned additives are well known for those skilled in the art, such as the pour point depressant can be poly α-olefin series like one or more of T803, T803A, T803B, and T805; the antioxidant can be one or more of antioxidation type succimide, zinc salt of alkyl phenol thiophosphate, and base zinc salt of dioctyl thiophosphate; the extreme pressure agent can be one or more of high temperature ashless friction reducer, amino thioester T323, and borated oleamide; the antifoaming agent can be one or more of T921 and T922; the metal deactivator can be one or more of composite agent containing thiadiazole derivative (T533), copper salt compound T541, and medium-alkali copper-containing calcium sulfonate complex T543. In the present invention, the aforementioned additive preferably has total content of 0.5-4 wt % based on total weight of the base oil.

The lubricating oil for diesel oil vehicle provided by the present invention can be prepared by various methods for common lubricating oils, such as mixing various components for forming the lubricating oil, such as base oil, viscosity improver, and dispersing agent, etc., and then colloidizing. As the present invention adds triazine compound into conventional lubricating oil to make the lubricating oil achieve effects of controlling or decreasing carbon soot particulate discharge of the diesel oil vehicle, there is no special requirement for conditions of mixing and colloidizing. Preferably, the mixing temperature is 60-90° C., more preferably 75-85° C.; and the mixing time is 30-80 min, more preferably 50-70 min. For preventing local heating, the mixing is preferably carried out under stirring. The colloidizing of the mixture is to make triazine compound be more uniformly dispersed in the base oil to give stable lubricating oil composition system. The colloidizing is preferably carried out at 75-85° C., and the colloidizing time is to make the lubricating oil free of layering after standing.

When the lubricating oil in the present invention further comprises one or more of dispersing agent, viscosity improver, friction reducer, and other additives, the preparation method for the lubricating oil in the present invention further comprises mixing one or more of dispersing agent, viscosity improver, friction reducer, and other additives with base oil and triazine compound. The present invention has no special requirement for mixing sequence of the aforementioned materials; the base oil can be mixed with triazine compound first, then mixed with one or more of aforementioned dispersing agent, viscosity improver, friction reducer, and other additives; or the base oil is mixed with one or more of aforementioned dispersing agent, viscosity improver, friction reducer, and other additives first, and then mixed with triazine compound. The detailed procedures of mixing and colloidizing are well known for those skilled in the art, and are not discussed here.

For further improving quality of the lubricating oil, preferably, the preparation method of the lubricating oil in the present invention further comprises separating lubricating oil obtained after collodization to remove solid particulate impurities in the lubricating oil. The separation method can be routine method, such as centrifugation separation.

The following embodiments will explain the present invention in further detail.

Example 1

100 kg SG/CF-4 gasoline/diesel oil with viscosity of 15w/40 is added into reactor, heated to 70° C. while stirring, then mixed with 3 kg mixture of triamino s-trazine and trihydroxy s-trazine (with molar ratio of 1:1), 0.3 kg dispersing agent T152, 2 kg PTFE, 0.5 kg Fjm-1 type oil friction reducer (produced by Beijing Greatwall lubricant Co. Ltd.), 0.2 kg metal deactivator T541, and 1 kg viscosity improver T612, stirred for 2 hr, repeatedly colloidizied with colloid mill for 5 times after temperature is lowered to room temperature, and centrifuge separated to remove solid impurities to give the lubricating oil composition S1 of the present invention.

Example 2

100 kg SG/CD gasoline/diesel oil with viscosity of 15w/40 is charged into reactor, heated to 90° C. while stirring, then mixed with 5 kg mixture of triamino s-trazine, 0.5 kg dispersing agent T152A, 0.5 kg MB202 type oil friction reducer, 0.5 kg viscosity improver T614, 1 kg pour point depressant T803, and 0.5 kg antifoaming agent T921, stirred for 2 hr, repeatedly colloidizied with colloid mill for 5 times after temperature lowered to 30° C., and centrifuge separated to remove solid impurities to give the lubricating oil composition S2 of the present invention.

Example 3

100 kg SG/CF-4 gasoline/diesel oil with viscosity of 10w/30 is charged into reactor, heated to 90° C. while stirring, then mixed with 1.5 kg mixture of triamino s-trazine and trihydroxy s-trazine (with molar ratio of 1.5:1), 1 kg polyalkenyl succimide ashless dispersing agent (prepared according to the method in CN 1126752A), 1 kg FOMP-1 type oil friction reducer, 3 kg viscosity improver T613, and 0.5 kg dispersing agent T155, stirred for 2 hr, repeatedly colloidizied with colloid mill for 5 times after temperature lowered to 30° C., and centrifuge separated to remove solid impurities to give the lubricating oil composition S3 of the present invention.

Example 4

Lubricating oil composition is prepared according to the method in example 1, except that the viscosity improver is upper 603, and the lubricating oil composition S4 of the present invention is obtained.

Example 5

Lubricating oil composition is prepared according to the method in example 1, except that the triazine compound is triamino s-triazine, and the viscosity improver is upper 603, and the lubricating oil composition S5 of the present invention is obtained.

Example 6

100 kg King Brand Chenglong series gasoline/diesel oil with viscosity of 15w/40 is charged into reactor, heated to 90° C. while stirring, then mixed with 1.5 kg mixture of triamino s-trazine and trihydroxy s-trazine (with molar ratio of 0.5:1), and stirred for 2 hr to give the lubricating oil composition S6 of the present invention.

Comparison Example 1

Lubricating oil composition D1 is prepared according to the procedure in the embodiment 1, except that the lubricating oil is not added with the mixture of triamino s-triazine and trihydroxy s-triazine.

Performance Test for Reduction of Carbon Soot Particulate in Automobile Exhaust Gas The lubricating oil composition S1-S6 prepared by the examples 1-6 and the lubricating oil composition D1 prepared by the comparison example 1 are respectively used in different types of diesel oil vehicles, and the exhaust gas discharged thereby is tested according to Beijing automotive testing method (operating mode method), in which bad smell of exhaust gas and raw oil odor can be sensed directly by human, and the testing results are shown in Table 1 as below; generally used smoke-meter method GB14761.6-93 is adopted for testing smoke number Rb, and the testing results are shown in Table 2 as below.

TABLE 1

| Vehicle Condition | Performance | | S1 | S2 | S3 | S4 | S5 | S6 | D1 | Requirements |
|---|---|---|---|---|---|---|---|---|---|---|
| Huanghai diesel bus run 170,000 Km | HSU (%) | 100% | 15.1 | 15.1 | 15.0 | 14.2 | 15.5 | 15.5 | 39.3 | ≦50 |
| | | 90% | 18.7 | 18.7 | 18.5 | 16.5 | 18 | 17 | 41.5 | ≦50 |
| | | 80% | 17.3 | 17.3 | 17 | 15 | 16 | 16 | 59.8 | ≦50 |
| | Wheel rim power (Kw) | | 83.3 | 83.5 | 83 | 86 | 85 | 85 | 33.6 | ≧73.5 |
| | Engineer Rotation Speed (rpm) | | 2054 | 2054 | 2054 | 2064 | 2055 | 2060 | 1985 | 1980-2420 |
| | Bad smell or raw oil ordor | | none | none | none | none | none | none | yes | none |
| Guilin Daewoo car run 60,000 Km | HSU (%) | 100% | 30 | 30 | 30 | 30 | 30 | 30 | 30 | ≦50 |
| | | 90% | 45 | 45 | 45 | 40 | 40 | 38 | 41.5 | ≦50 |
| | | 80% | 34 | 34 | 34 | 32 | 34 | 40 | 49.8 | ≦50 |
| | Wheel rim power (Kw) | | 56 | 56 | 56 | 59 | 56 | 56 | 33.6 | ≧40 |
| | Engineer Rotation Speed (rpm) | | 3059 | 3059 | 3059 | 3259 | 3100 | 3150 | 3030 | 2700-3300 |
| | Bad smell or raw oil ordor | | none | none | none | none | none | none | yes | none |

TABLE 2

| | smoke number Rb | | | | | | | |
|---|---|---|---|---|---|---|---|---|
| Vehicle Condition | S1 | S2 | S3 | S4 | S5 | S6 | D1 | requirements |
| Beiqi Foton four wheel agricultural vehicle (new) | 1.8 | 1.8 | 1.8 | 1.8 | 1.8 | 1.8 | 3.6 | <3.5 |
| Beiqi Foton four wheel agricultural vehicle run 1500 Km (in use) | 2.11 | 2.11 | 2.11 | 2.11 | 2.11 | 2.11 | 3.34 | <4 |
| Domestic QY8 Huanghe crame run 50,000 Km (in use) | 1.9 | 1.9 | 1.9 | 1.8 | 1.8 | 1.9 | 5.1 | <4 |
| Hino 40T large scale duty diesel oil vehicle run 380,000 Km (in use) | 3.0 | 3.0 | 3.0 | 2.5 | 2.5 | 3.0 | 5.8 | <4 |

It can be seen from the results in the Table 1 and Table 2, no matter which testing method is adopted for testing, the exhaust gas discharged by automobile using the lubricating oil composition provided by the present invention can meet the standard, which means that the lubricating oil composition provided by the present invention can effectively reduce carbon soot particulate discharge amount of automobile, so as to achieve the goal of controlling exhaust gas discharge, eliminating bad smell and raw oil odor from engine source, and improving wheel rim power. Under same conditions, lubricating oil prepared by combining mixture of triamino s-triazine and trihydroxy s-triazine and polymethacrylate viscosity improver has performance significantly better than that of the lubricating oil comprising other viscosity improver.

Although the aforementioned embodiments do not give other physical parameters of the lubricating oil composition provided by the present invention, the test result shows that the lubricating oil provided by the present invention has viscosity index no lower than that of general lubricating oil, pour point (tested by GB/T3535) lower than that of same grade available lubricating oil by 10-15%, copper strip corrosion test result (tested by GB5096-85) of grade Ia which is better than that of available commercial general lubricating oil (which is only grade I), $P_B$ and $P_D$ value (tested by GB3142-82) higher than those of same grade available lubricating oil by 10-15%, and excellent antifoaming property (tested by GB/T12579).

The invention claimed is:

1. A lubricating oil composition for diesel oil vehicle consisting of a lubricating base oil, a triazine compound and a viscosity improver, wherein said triazine compound is a mixture of a triamino s-triazine and a trihydroxy s-triazine, and the viscosity improver has content of 0.5-5 wt % based on the weight of the base oil, and wherein the viscosity improver is a polymethacrylate.

2. The composition according to claim 1, wherein the triazine compound has content of 1-5 wt % based on the weight of the lubricating base oil.

3. The composition according to claim 2, wherein the molar ratio of the triaminos-triazine to trihydroxy s-triazine in the mixture is of 0.5-1.5.

4. The composition according to claim 1, wherein the viscosity improver has content of 0.5-3 wt %.

5. A lubricating oil composition for diesel oil vehicle consisting of a lubricating base oil, a triazine compound, a viscosity improver, a dispersing agent, a friction reducer and other additives, wherein said triazine compound is a mixture of a triamino s-triazine and a trihydroxy s-triazine; the viscosity improver has content of 0.5-5 wt % based on the weight of the base oil, and the viscosity improver is polymethacrylate; each of the dispersing agent, friction reducer and other additives has content of 0-5 wt %, the other additives include one or more of pour point depressant, antioxidant, extreme pressure agent, antifoaming agent, and metal deactivator.

6. A method for preparing the lubricating oil composition for diesel oil vehicle according to claim 1, comprising mixing the base oil and the viscosity improver with the triazine compound, and then colloidizing.

7. The composition according to claim 5, wherein the dispersing agent is one or more selected from the group consisting of polyisobutylene succinimide, dialkenyl succinimide, polyisobutylene succinate, polyisobutylene ashless phosphate, and polymethacrylate; the friction reducer is one or more selected from the group consisting of organomolybdenum friction reducer, polytetrafluoroethylene, and organoboron friction reducer.

* * * * *